US005671707A

United States Patent [19]

Purcell et al.

[11] Patent Number: 5,671,707

[45] Date of Patent: Sep. 30, 1997

[54] ROCKER LEVEL OIL SHROUD

[75] Inventors: John Jerl Purcell; Cynthia I. Mandt; Francis M. Hager, all of Columbus, Ind.

[73] Assignee: Cummins Engine Company, Inc., Columbus, Ind.

[21] Appl. No.: 608,498

[22] Filed: Feb. 28, 1996

[51] Int. Cl.[6] ..... F01L 9/10

[52] U.S. Cl. ..... 123/90.37; 123/90.39; 74/559

[58] Field of Search ..... 123/90.33, 90.36, 123/90.37, 90.39, 90.4, 90.41, 90.44; 74/519, 559

[56] References Cited

U.S. PATENT DOCUMENTS

| | | | |
|---|---|---|---|
| 2,123,681 | 7/1938 | Willgoos | 123/90.37 |
| 2,522,326 | 9/1950 | Winter, Jr. | 123/90.36 |
| 2,667,149 | 1/1954 | Purchas, Jr. et al. | 123/90.37 |
| 2,955,581 | 10/1960 | Fedak | 123/90.42 |
| 3,410,366 | 11/1968 | Winter, Jr. | 123/90.36 |
| 3,667,434 | 6/1972 | Sandusky | 123/90.37 |
| 3,875,908 | 4/1975 | Ayres | 123/90.37 |
| 4,875,442 | 10/1989 | Akao et al. | 123/90.39 |

*Primary Examiner*—Weilun Lo

*Attorney, Agent, or Firm*—Sixbey, Friedman Leedom & Ferguson; Charles M. Leedom, Jr.; Joan K. Lawrence

[57] ABSTRACT

A rocker lever assembly including lubricant directing structure is provided for an internal combustion engine drive train. A lubricant deflecting shroud is secured to a joint-contacting end of a rocker lever above open lubricant channels to direct lubricant to an adjacent drive train joint and minimize airborne lubricant.

10 Claims, 3 Drawing Sheets

ROCKER LEVEL OIL SHROUD

TECHNICAL FIELD

The present invention relates generally to rocker levers and rocker lever assemblies in internal combustion engine drive trains and particularly to a lubricant deflecting shroud or shield for a rocker lever which provides a cost-efficient means for assuring an adequate flow of lubricant from a rocker lever to drive train joints and contact surfaces.

BACKGROUND OF INVENTION

In an internal combustion engine it is vital that all joints and bearing surfaces be properly lubricated, especially in high performance engines that operate at very high speed. If too little lubricant is supplied to these joints, the frictional forces created by their movement will not be overcome, and they will overheat and eventually fail. Engine drive trains include rocker arms or levers and other moving parts which must be capable of rapid repetitive movement thousands of times each minute. Providing for the adequate lubrication of such structures in a cost-effective manner has long been a concern of the prior art.

The drive train of an internal combustion engine typically includes a number of reciprocating rocker arms or levers which operate to transmit the rotational movement of the camshaft to the reciprocal movement required to actuate the engine valves and/or fuel injectors. Lubricant, typically engine oil, may be supplied to each rocker lever from the engine oil supply in a variety of ways. Once the oil reaches the rocker lever, it is available to lubricate the rocker lever support surface and the rocker lever contact surfaces. However, unless some effort is made to direct the lubricant to those structures where it is needed, the lubricant may be splashed about the rocker lever assembly and will not reach all of the structures requiring lubrication. This problem is particularly acute with a rocker lever that has an open channel in its top surface. Although such a channel may have been designed to direct lubricant oil toward the ball and socket joint or other structure which couples the rocker lever to a crosshead assembly or valve stem, most of the oil tends to be slung off the lever in an upward direction during engine operation and never reaches the ball and socket joint. As a result, excessive airborne or suspended oil is generated in the vicinity of the drive train, while only minimal or no oil reaches structures at an end of the rocker lever requiring lubrication.

Some prior art rocker lever structures include a deflecting means mounted in or adjacent to the rocker lever for deflecting lubrication back into a channel formed in the rocker lever. Such structures are shown in U.S. Pat. Nos. 3,667,434 to Sandusky and 2,955,581 to Fedak. These deflectors, however, are not mounted directly on the rocker lever and are designed to deflect lubricant toward a central bearing assembly and not toward the joints or bearing surfaces at one end of the rocker lever.

A rocker lever including a shroud-like member is shown in U.S. Pat. No. 4,875,442 to Akao. This shroud, however, extends over the entire top of a ceramic rocker lever and is used for the purpose of protecting the engine from the broken pieces of the ceramic rocker lever in the event of the rocker lever's destruction. The direction of lubricant toward a joint-contracting end of the rocker lever is not suggested.

Currently, there are two primary methods of insuring an adequate supply of lubricant to the ball and socket joint at the rocker lever and crosshead or injector valve stem interface. One method involves a series of drillings to direct pressurized lubricant into this joint. While this method effectively provides adequate lubricant to the joint and limits the amount of suspended, wasted oil, it is very expensive. The high cost of the lengthy, small diameter drillings required to produce this result may make a rocker lever with this feature prohibitively expensive for many applications.

The second method involves forming an open groove in the top of the rocker lever to channel lubricant to the joint contacting end of the rocker lever. While this method is cost effective, it does not avoid the problems discussed above. During engine operation, the angular acceleration of the lubricant at high speed causes lubricant oil to be flung outwardly from the open groove, producing excessive airborne lubricant in the blowby gas, which significantly reduces lubricant flow to the ball and socket joint at high engine speeds. Consequently, the joint may be inadequately lubricated.

The prior art has failed, therefore, to provide a rocker lever or rocker lever assembly for an internal combustion engine which includes simple, inexpensive structure for assuring a targeted flow of lubricant to the crosshead, injector or valve stem-contacting end of the rocker lever. A need exists for a cost-efficient structure and method for assuring such a continuous targeted flow of lubricant to the drive train joints contacted by the engine rocker levers which does not produce an excess of airborne lubricant, that is ineffective for its intended purpose.

SUMMARY OF THE INVENTION

It is a primary object of the present invention, therefore, to overcome the deficiencies of the prior art and to provide a rocker lever assembly for an internal combustion engine which includes simple, inexpensive structure secured directly to a rocker lever which insures a targeted flow of lubricant to a joint-contacting end of the rocker lever.

It is a further object of the present invention to provide an oil or lubricant deflecting shroud mounted on a rocker lever in an internal combustion engine drive train which captures oil during engine operation and minimizes airborne oil.

It is another object of the present invention to provide an inexpensive rocker lever for a rocker lever assembly for an internal combustion engine drive train with an open lubrication channel that is cast or stamped instead of drilled to direct lubricant to a joint-connecting end of the rocker lever.

It is yet a further object of the present invention to provide a fitted shroud corresponding to the configuration of a rocker lever that is secured to and covers an entire joint-contacting end of a rocker lever.

It is yet another object of the present invention to provide a lubricant deflecting shroud for a rocker lever that may be installed as original equipment or retro fitted for installation on an existing rocker lever.

It is a still further object of the present invention to provide lubricant directing structure for a rocker lever assembly that minimizes airborne lubricant in engine blowby gas.

The present invention provides a rocker lever assembly for an internal combination engine drive train. The rocker lever assembly includes at least one rocker lever mounted on a support shaft for pivotal movement about the shaft. The rocker lever, which pivots or reciprocates between a push rod and contact with a ball and socket joint on a crosshead assembly, valve stem or injector during engine operation, is formed with open lubricant channels in the rocker lever upper surface. A lubricant deflecting shroud configured to correspond to the configuration of the joint-contacting end of the rocker lever is secured directly to the joint-contacting end to cover the open lubricant channels at this end of the rocker lever and to retain lubricant in the channels. A supply of lubricant is thereby directed to the ball and socket joint, and airborne lubricant is minimized.

Other objects and advantages will become apparent following an examination of the following description, drawings and appended claims.

DETAILED DESCRIPTION OF PREFERRED EMBODIMENTS

The present invention is designed to overcome the disadvantages of known rocker lever lubricant directing structure for an internal combustion engine drive train and/or valve train and to provide a structure which will substantially eliminate airborne lubricant by assuring that lubricant is directed to the ball and socket joint at the valve stem or injector contacted by the rocker lever. Lubricant is targeted to the joint-contacting end of the rocker lever by an oil deflecting shroud positioned at this end of the rocker lever. The oil deflecting shroud is located above an open channel in the rocker arm and is positioned so that lubricant which is supplied to the open channel on the rocker lever is contained substantially within the channel and directed onto the bearing surface of the ball and socket joint. This arrangement effectively assures adequate lubrication for the ball and socket joint and minimizes airborne lubricant during engine operation when the engine is operating at high speeds.

Figure 1A:
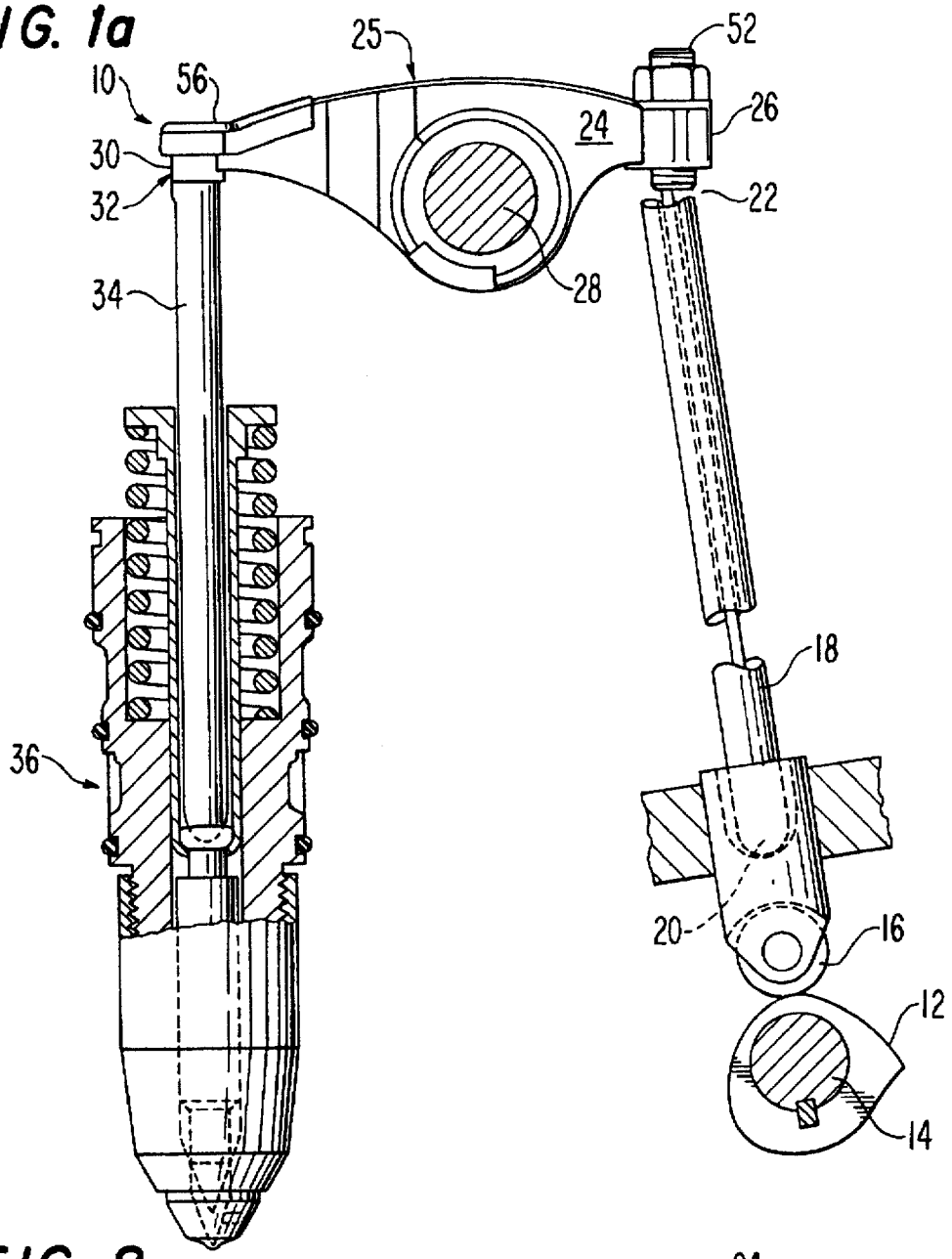
FIG. 1*a* is a side view of an internal combustion engine drive train showing the rocker lever assembly of the present invention with a fuel injector.
Figure 1B:
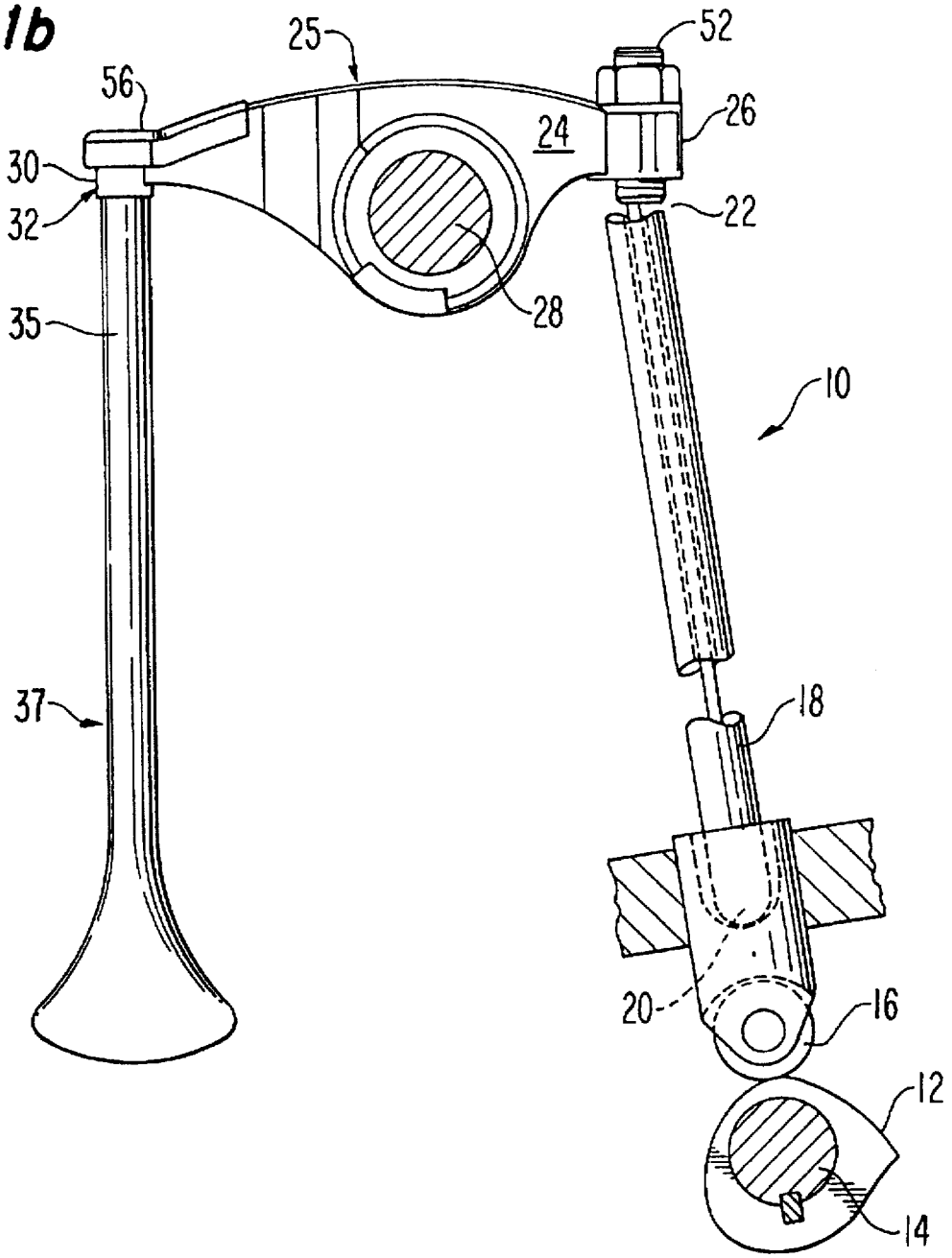
FIG. 1*b* is a side view of an internal combustion engine drive train showing the rocker lever assembly of the present invention with a valve.
Figure 3:
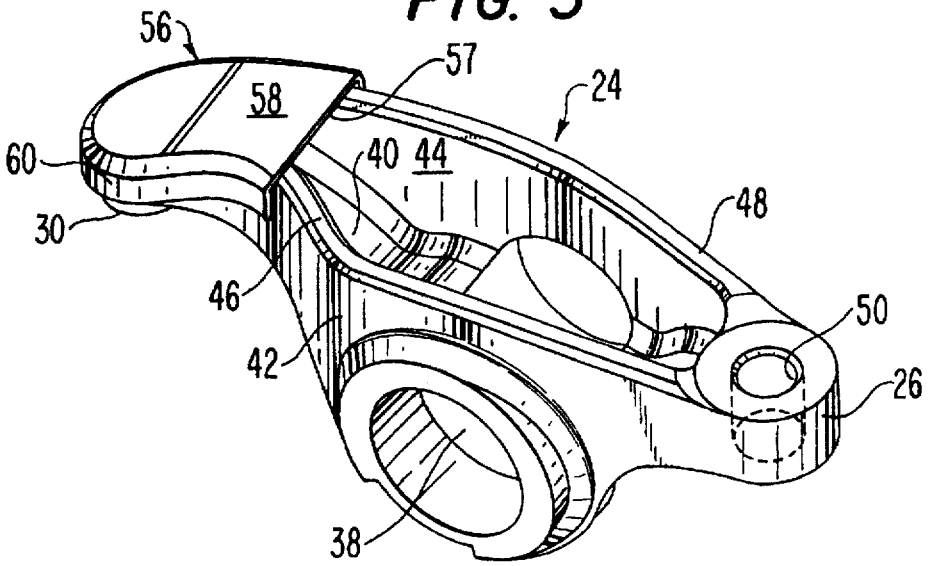
FIG. 3 is a perspective view of the side and top face of the rocker lever of the present invention.

Referring now to the drawings in which like reference numerals designate like parts throughout the several views thereof, FIG. 1 illustrates an internal combustion engine drive train 10. The drive train 10 of FIG. 1 includes a fuel injector; however, it could alternatively include one or more valve stems. The drive train 10 includes a cam 12 mounted on and keyed to a rotatable cam shaft 14. A cam follower 16 connected to one end 20 of a push rod 18 rides on the cam 12. The opposite end 22 of push rod 18 drivingly contacts one end 26 of a rocker lever 24 in a rocker lever assembly 25. The rocker lever 24 is mounted to reciprocate about a shaft 28. The shaft 28 may be mounted on the engine block cylinder head by anyone of a number of support pedestals or like structures. A second end 30 of the rocker lever 24 is in driving contact with a fuel injector plunger, valve stem or crosshead assembly. FIG. 1*a* illustrates contact with the operable elements of a fuel injector. However, the rocker lever assembly 25 of the present invention can be used to equal advantage with other drive train elements, such as the valve shown in FIG. 1*b*, as well. The connection between the rocker lever end 30 and the fuel injector plunger, valve stem or like element is typically a joint that will require lubrication to prevent heat buildup from friction created by the contact between the rocker lever joint contacting end 28 and the plunger or valve stem. A ball and socket joint of the type described in commonly owned U.S. Pat. No. 4,794,894 to Gill is illustrative of the kind of joint 32 used at this location in an engine drive train.

The rocker lever assembly 25 of FIGS. 1*a* and 1*b* forms a driving contact joint between the end 28 of the rocker lever 24 and the plunger 34 of a unit fuel injector 36 or the stem 35 of an intake or exhaust valve 37. The rotational motion of the cam follower 16 is transmitted through the push rod 18 to the end 26 of the rocker lever, whereupon the rocker lever 24 pivots about the rocker shaft 28. The end 26 of the rocker lever 24 is pushed up, which forces the end 30 of the rocker lever 24 into contact with the plunger 34 or valve stem 35, causing fuel to be injected or, alternatively, an intake or exhaust valve to be actuated.

The lubricant supply to the rocker lever assembly 24 of FIG. 1 is not shown. Lubricant may be supplied to the shaft 28 and other rocker lever assembly structures in a number of ways. The objective is to provide a sufficient supply of lubricant, usually engine oil, to all moving parts and contact joints to dissipate heat generated by the frictional forces created during engine and drive train operation. The rocker lever contact joint 32 had been difficult to keep properly lubricated, in part because the design of many rocker levers provides open rather than closed lubricant passages. The cost of making a rocker lever with open lubricant passages, which can be cast or stamped, is significantly less than that of forming a rocker lever with internal lubricant passages that must be drilled to direct lubricant to a joint-contacting end. However, the rapid reciprocal movement of a rocker lever with open lubricant channels during engine operation causes a quantity of lubricant to be thrown from the rocker lever into the engine space around the drive train, even though the lubricant channels are designed to direct lubricant toward the contact ends. The present invention provides a simple, inexpensive structure that may be installed as part of the originally manufactured rocker lever assembly or retrofitted to an existing rocker lever assembly.

FIGS. 2, 3, 4 and 5 illustrate, in detail, the kind of rocker lever design with which the present invention may be advantageously used. The present invention could be installed on any rocker lever design which incorporates open lubricant channels where it is desired to direct a substantial amount of lubricant to a joint-contacting end of the rocker lever so that the quantity of airborne lubricant generated during engine operation is minimized.

Figure 2:
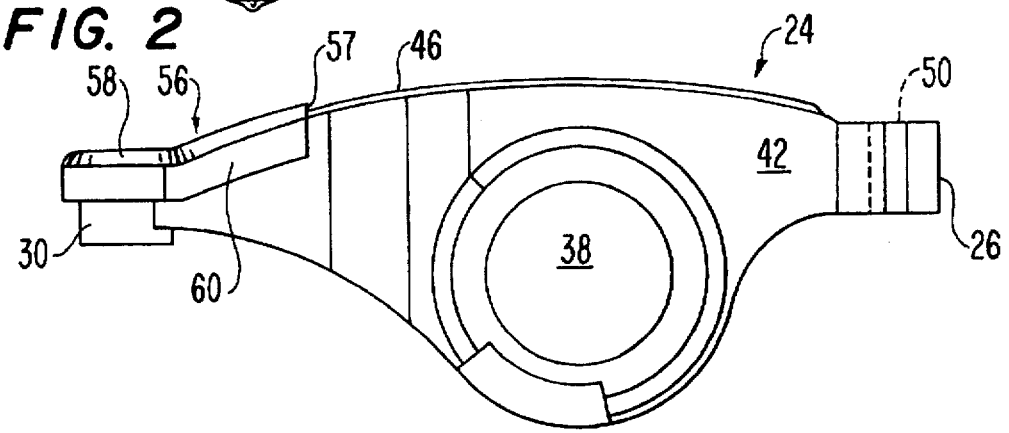
FIG. 2 is a side view of a rocker lever according to the present invention.

The rocker lever 24 of the present invention is illustrated on the shaft 28 unmounted and isolated from the drive train 10 to show clearly the details of the lubricant directing structure. The rocker lever 24 is essentially boat-shaped and has an open top surface. A bore 38, through which the mounting shaft 28 (FIG. 1) normally extends, bisects the floor 40 of the rocker lever 24. A pair of side walls 42 and 44 extend upwardly away from the floor 40 to define an open cavity 45 (FIG. 5). Lubricant channels 46 and 48 are formed in the upper surfaces of walls 42 and 44, respectively. The push rod contacting end 26 of the rocker lever includes a bore 50 to receive an adjusting screw 52 (FIG. 1) or like structure to achieve an effective push rod contact. At least some lubricant directed to the rocker lever bore 50 from the push rod 18 is directed toward the rocker lever joint-contacting end 30 through the channels 46 and 48 along the path shown by the arrows in FIG. 4. The configuration of the side profile of the rocker lever facilitates the direction of lubricant toward end 30. In FIG. 2, the upper surface of the side wall 42 which contains the lubricant channel 46 slopes toward the joint-connecting end 30 so that the channel 46 is lower at this end than it is in the area near the central shaft-receiving bore 38. The opposite side wall 44 has a corresponding sloping profile, which tends to direct lubricant toward the rocker lever end 30.

Figure 4:
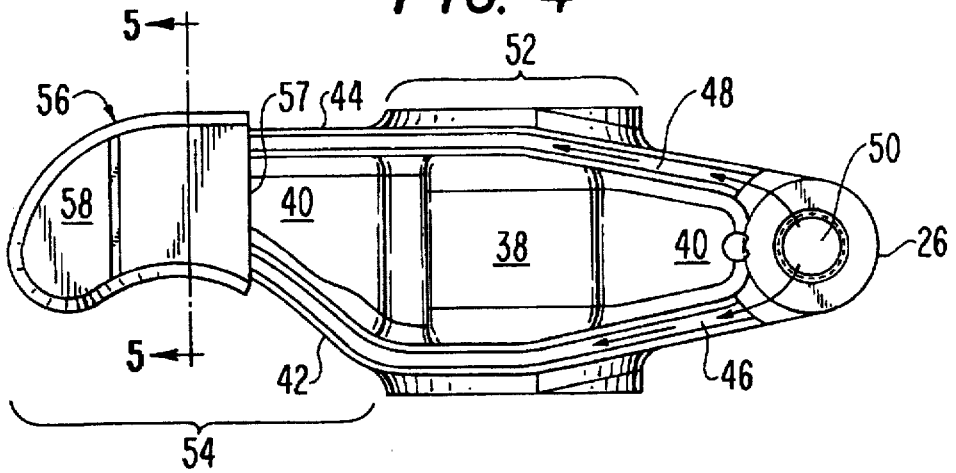
FIG. 4 is a top view of a rocker lever according to the present invention.
Figure 5:
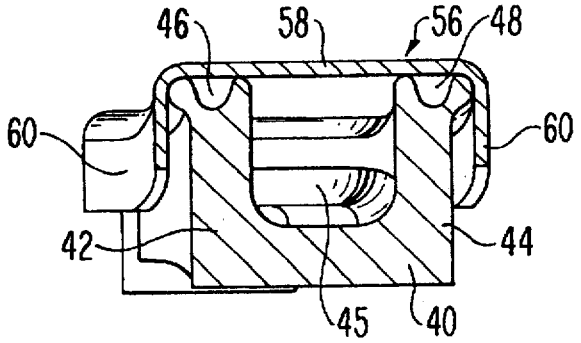
FIG. 5 is a cross-sectional view taken along the line 4—4 of FIG. 4 of the rocker lever of the present invention

The top profile of the rocker lever 24, which can be most clearly seen in FIG. 4, is also designed to direct lubricant to the joint-contacting end 30. The side walls 42 and 44 are not parallel, but define a central section 52 in the vicinity of the bore 38 that is significantly wider than either end 26, 30 of the rocker lever. The joint-contacting end 30 has the curved configuration shown in area 54 to allow the most efficient connection capability with the injectors and/or valves in different engines. Other rocker lever configurations can also use the lubricant shroud of the present invention, however.

To insure that the lubricant which is directed toward the joint-contacting end 30 of the rocker lever 24 by the channels 46 and 48 is retained at end 30 long enough to lubricate the joint 32 during engine operation, the present invention provides a lubricant deflecting shield or shroud 56 which is configured to cover and fit securely over the joint-contacting end 30 of the rocker lever 24. The lubricant deflecting shroud 56 covers the open cavity 45 over the end 30 of the rocker lever. The shroud 56 includes a planar surface 58 which covers the cavity 45. A skirt 60, preferably formed integrally with the planar surface 58, extends from the terminal edge 57 of the shield around the joint-contacting end 30 of the rocker lever 24. The skirt 60 extends over the side walls 42 and 44 at this end of the rocker lever. The shroud 56 is attached directly to the rocker lever. Attachment may be accomplished by any one of a number of methods used for securing internal combustion engine components together, such as banding or staking. Although the attachment method chosen should preferably permanently secure the shroud to the rocker lever, the shroud could also be removably attached, provided the attachment is sufficiently secure to withstand the forces exerted during engine operation.

This arrangement decreases the amount of airborne lubricant while directing the lubricant flow to the joint 32. When high speed oscillation would otherwise force the oil or lubricant from the open channels 46 and 48 into the area above the rocker lever, the lubricant is deflected by the shroud 56 downward back into the open channels 46 and 48 toward the joint 32.

FIG. 5 clearly shows the position of the lubricant deflecting shroud 56 over the rocker lever 24 at the line 4—4 in area 54 of FIG. 4. The shroud 56 completely encases the end 30 of the rocker lever. Lubricant that has been deflected by the lubricant deflecting shroud 56 is directed from the channels 46 and 48 and into cavity 45 and is available to be targeted to the joint 32.

Various modifications of the above-described embodiment of the invention will be apparent to those skilled in the art and it is understood that those modifications can be made without departing from the scope of the invention, if they are within the spirit and tenor of the accompanying claims.

INDUSTRIAL APPLICABILITY

The rocker lever assembly of the present invention with its lubricant-deflecting shroud will find its primary application in an internal combustion engine drive train where a simple cost-effective structure for directing lubricant to rocker lever contact joints is desired.

We claim:

1. A rocker lever assembly for an internal combustion engine drive train designed to maximize lubricant flow to a drive train joint at a contact end of a rocker lever and to minimize airborne lubricant, wherein the rocker lever assembly includes:

(a) a rocker lever mounted on a shaft in said drive train for reciprocal movement between contact with a camshaft-actuated push rod and contact with at least one of an actuating element of a fuel injector or valve, said rocker lever body having an open boat-shaped configuration including open lubricant channels formed on upper surfaces of said rocker lever to direct lubricant toward the actuating element contact end of said rocker lever;

(b) a lubricant supply in fluid communication with the rocker lever to provide a supply of lubricant to the rocker lever mounting and contact structures during engine operation; and (c) a lubricant deflecting shield configured to conform to the shape of and to cover the actuating element-contacting end of the rocker lever to direct lubricant from the lubricant channels at said actuating element-contacting end toward said actuating element.

2. The rocker lever assembly described in claim 1, wherein said lubricant deflecting shroud includes a planar top surface configured to cover and extend over the rocker lever body a distance from said actuating element-contacting end selected to maximize the amount of lubricant direct toward said actuating element-contacting end and to minimize the amount of airborne lubricant and a skirt integrally formed with and substantially perpendicular to said planar surface to cover at least a portion of said rocker lever body.

3. The rocker lever assembly described in claim 1, wherein said lubricant deflecting shroud is integrally formed with said rocker lever to cover the actuating element-contacting end.

4. The rocker lever assembly described in claim 1, wherein said lubricant deflecting shroud is substantially permanently secured to said rocker lever body.

5. The rocker lever assembly described in claim 1, wherein said lubricant deflecting shroud is removably secured to said rocker lever body.

6. A rocker lever for an internal combustion engine drive train comprising a boat-shaped body, said rocker lever body having a bottom wall and two side walls extending upwardly from the bottom wall and structurally integrally formed therewith to define a body cavity, said body having a bore in a side wall at the intermediate portion of said body for receiving a rocker shaft to pivotally mount said rocker lever, said body including a contact portion in one end to form a joint with at least one of a valve stem or fuel injector, and a push rod engaging structure in the opposite end to engage an end of a push rod, said body further including an open channel formed in said body at the top edge of each said side walls, wherein a lubricant deflecting shroud is fitted over said body cavity at the body contact portion, said lubricant deflecting shroud being formed with a planar upper surface that covers said body cavity and skirts that extend downwardly from said planar upper surface and fit over said side walls of said body.

7. The rocker lever described in claim 6, wherein the configuration of the lubricant deflecting shroud conforms to the shape of the rocker lever body.

8. The rocker lever described in claim 7, wherein said lubricant deflecting shroud is substantially permanently secured to said rocker lever body by banding or staking.

9. The rocker lever described in claim 7 wherein said lubricant deflecting shroud is removably secured to said rocker lever body.

10. A lubricant deflecting shield for covering a drive train joint-contacting end of an open top rocker lever in an internal combustion engine drive train to minimize airborne lubricant and to maximize lubricant directed to said joint-contacting end, wherein said shield has a shape that conforms to the shape of the joint-contacting end and is secured directly to the rocker lever to cover a sufficient portion of the rocker lever open top to insure the direction of a maximum amount of lubricant to the rocker lever joint-contacting end while minimizing airborne lubricant.

* * * * *